United States Patent [19]

Noyes et al.

[11] Patent Number: 4,655,352

[45] Date of Patent: Apr. 7, 1987

[54] EXPANDABLE DISPLAY RACK FRAME

[75] Inventors: Androus D. Noyes, Fairfield; Joseph T. Ricci, Bethel, both of Conn.

[73] Assignee: Duracell Inc., Bethel, Conn.

[21] Appl. No.: 702,777

[22] Filed: Feb. 19, 1985

[51] Int. Cl.[4] ..... A47F 5/00

[52] U.S. Cl. ..... 211/175; 211/189; 211/201; 40/539; 40/605; 40/610; 108/106; 108/144

[58] Field of Search ..... 211/175, 189, 207, 208, 211/201, 103, 90, 188; 108/106, 144, 60; 52/632; 40/610, 605, 539, 571; 248/220.3

[56] References Cited

U.S. PATENT DOCUMENTS

| | | | |
|---|---|---|---|
| 176,512 | 4/1876 | Chinnery | 108/144 X |
| 284,873 | 9/1883 | Marsh | 108/144 X |
| 2,023,419 | 12/1935 | Hailparn | 40/539 |
| 2,035,651 | 3/1936 | Hailparn | 40/539 |
| 2,657,810 | 11/1953 | Garrick | 108/144 X |
| 2,987,195 | 6/1961 | Smith | 211/175 |
| 3,226,172 | 12/1965 | Bateman | 108/60 X |
| 3,602,159 | 8/1971 | Marschak | 248/220.3 X |
| 3,921,345 | 11/1975 | Damico | 52/36 X |
| 4,127,196 | 11/1978 | Boucher | 211/207 |
| 4,489,306 | 12/1984 | Scolari | 40/610 X |
| 4,523,722 | 6/1985 | Cohen et al. | 211/189 X |
| 4,560,062 | 12/1985 | Valiulis | 248/220.3 X |

*Primary Examiner*—Ramon S. Britts
*Assistant Examiner*—Blair M. Johnson
*Attorney, Agent, or Firm*—Ronald S. Cornell

[57] ABSTRACT

An expandable and contractible frame, for a display rack, which comprises moveable telescoping sides and an extendible top valance which are placed against and supported by an existing display such as a perforated board and a base such as a store gondola. The frame can be adjusted for the most advantageous display of merchandise.

10 Claims, 5 Drawing Figures

Fig. 2
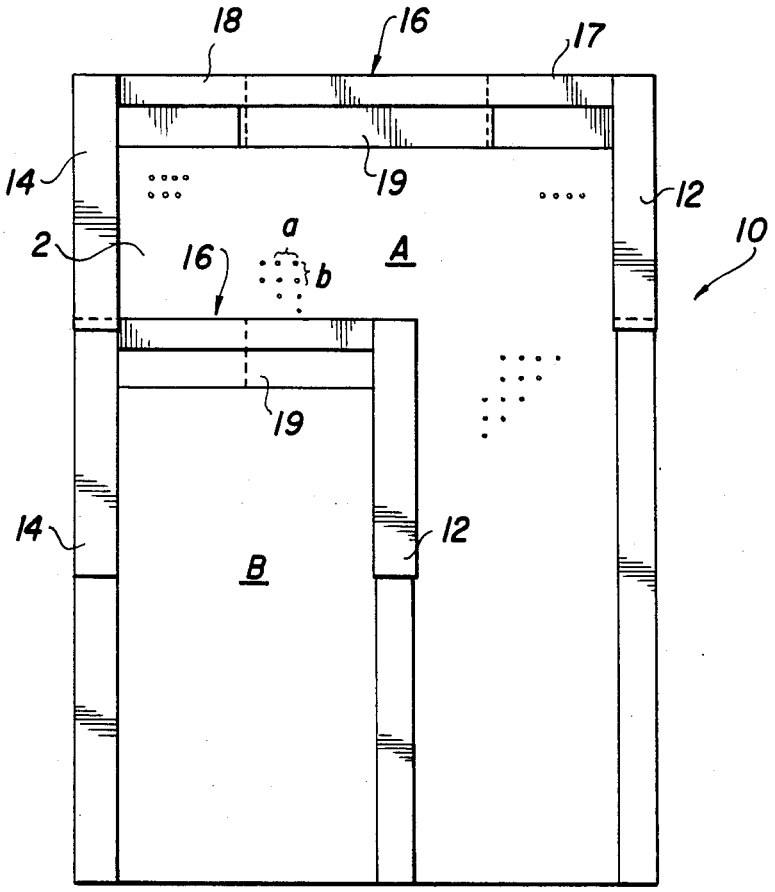
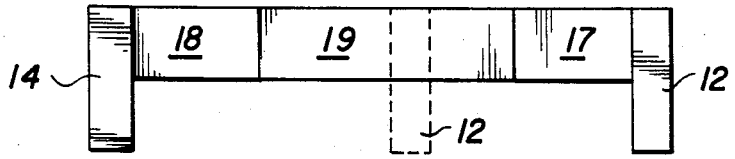
Fig. 3

Fig. 4
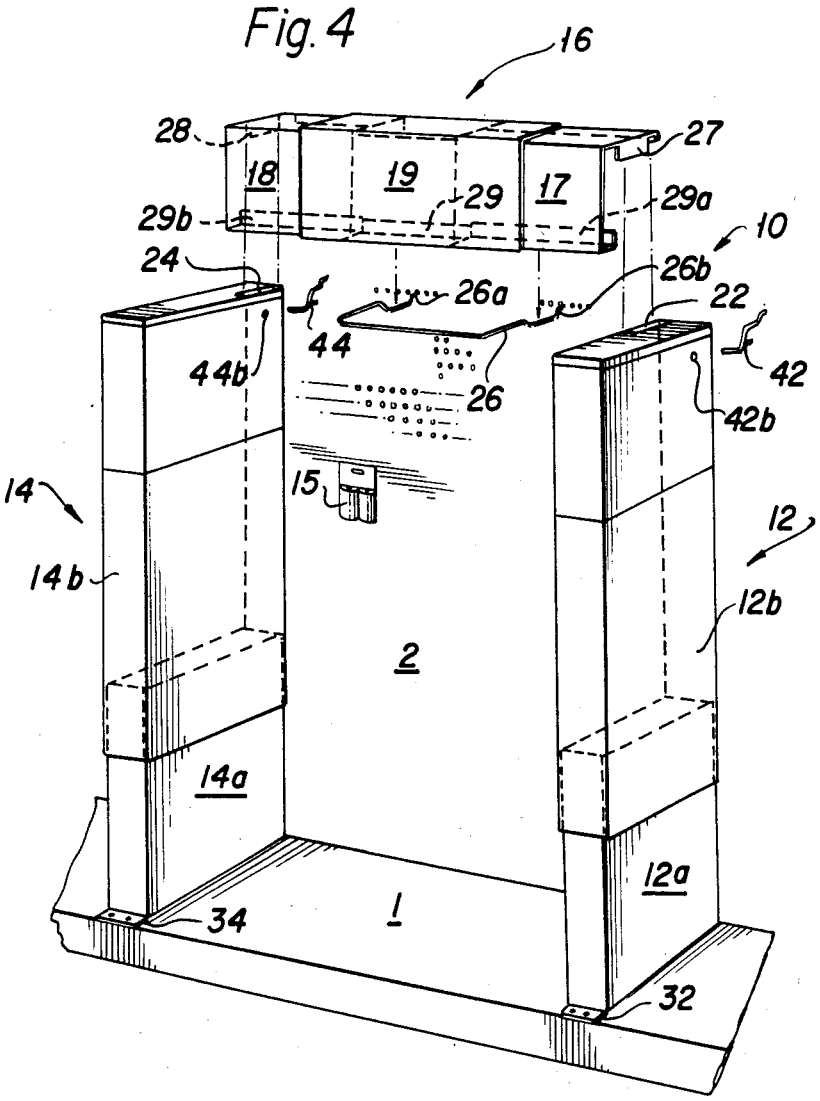
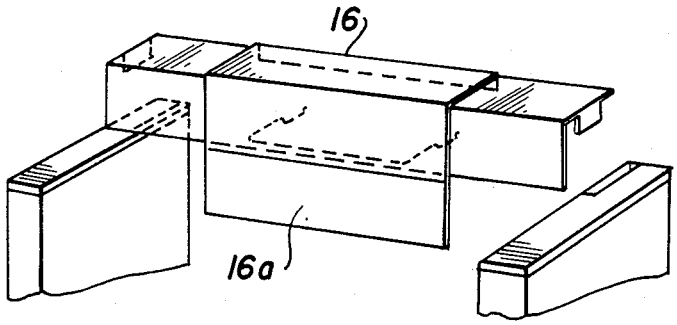
Fig. 5

EXPANDABLE DISPLAY RACK FRAME

This invention relates to displays for merchandise purchasing and particularly to adjustable size hanging displays.

A merchandising technique, generally at the retail level, is the display of relatively small products on hanging racks to more readily catch the eye of a consumer. Such technique, generally embodied by the use of perforated boards (such as Peg-Board (Monsanto Corp. TM) perforated boards) with hangers, provides a highly visible display of products with enhanced sales generation. In many instances manufacturers provide the entire display as a single unit for the enhanced display of their products. Where such manufacturer-provided displays are not available, retailers generally erect perforated boards (on supporting bases or gondolas) on which a wide variety of small items such as kitchen gadgets, hardware (packages of nails, screws, bolts and the like), etc. are hung for display and facilitated purchase.

It is an object of the present invention to provide an adjustable display rack frame which utilizes existing store perforated boards and the like for the most effective utilization of display space in an aesthetically pleasing product display.

It is a further object of the present invention to provide such adjustable display rack frame for maintaining such aesthetically pleasing product display with both reduced or increased amounts of merchandise items.

These and other objects, features and advantages of the present invention will become more evident from the following discussion as well as the drawings in which:

FIG. 2 is a front view of the display rack frame of the present invention shown in varying adjustable sizes of both height and width;

FIG. 3 is a plan view taken along line 3—3 of FIG. 2;

FIG. 4 is a partially exploded view of the display rack fame of the present invention being assembled on an existing store perforated board and supporting gondola; and FIG. 5 is an alternative structure for the display valance shown in FIG. 4.

Figure 1:
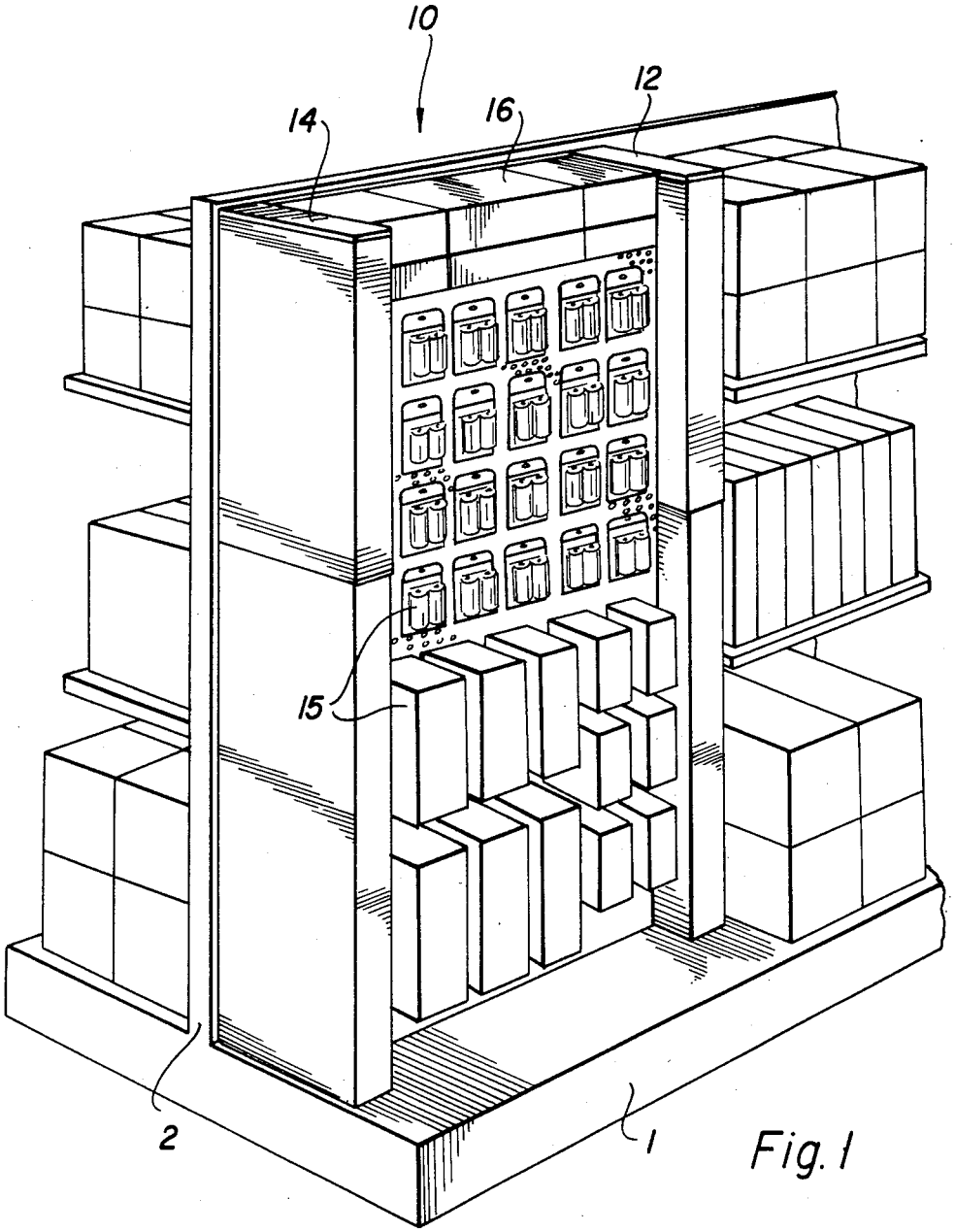
FIG. 1 is an isometric view of the display rack frame of the present invention.

Generally the present invention comprises an adjustable product display frame for use with existing display means to enhance the aesthetic display of merchandise for consumer purchase. One type of display is that of a vertically standing article display member such as a perforated board which is supported on a base such as the floor or a gondola. In product outlets such as retail stores, existing displays generally comprise such perforated boards with gondola bases for both the stacking of and hanging of merchandise. Such merchandise is generally contained in small boxes, blister cards etc. which are apertured specifically to be hung on elongated hooks or hangers supported by the perforated board. The present invention comprises a means for suitably and aesthetically framing the so displayed merchandise with such means being adjustable to compensate for reduction or increase in the number of displayed products with reduced amount of unsightly bare areas or the necessity for overloading product display hangers. The product display frame of the present invention comprises substantially parallel and vertical right and left side members and a decorative top or valance member positioned between the upper ends of the right and left side members. The base for the article display member such as the floor or gondola provides the bottom for the frame. Both side members are vertically telescopical with at least one being laterally or horizontally moveable along an existing base such as a floor or store gondola in order to expand or contract the frame in either or both height and width dimensions. The top member or valance is substantially parallel to the base such as a gondola and is concomitantly expandable or contractible to accommodate the lateral or horizontal movement of the side members in order to maintain a closed frame. The side members are vertically positioned and the valance member is horizontally positioned in close if not supportive juxtaposition with the existing vertically standing article display member such as the perforated board to provide a full aesthetically pleasing frame for articles supported by the display member. It is preferred that the side members include removeable means for the anchoring thereof to the base or gondola when the desired size frame has been formed. It is further preferred that the top member or valance be supported by both the side members at its peripheral ends and centrally with a brace member, preferably of wire, attached to the existing display rack such as with hooks to a perforated board. Fixing of the telescoped (contracted or expanded) sides into position is preferably effected by supporting means such as hooks adjustably placed on an existing perforated board. Though, when in a fully closed position, the sides may require only a base support such supporting hooks are still preferred for added stability. For strength and some decorative purposes it is preferred that the side members and valance be comprised of metal, though plastic or cardboard may be similarly utilized.

A preferred structure for the display frame of the present invention comprises side members configured as hollow rectangular columns with each of said columns comprising a column base member which stands on and is anchored to an existing base such as a store gondola and at least one vertically moveable member nestingly seated on or in said base member. The vertically moveable member further embodies an aperture for the supportive affixation thereof to the perforated board by a hook. The top member or valance, in the preferred structure, is comprised of an L-shaped member comprising a central section with right and left (preferred for symmetry) extensible sections nestingly contained therein. The extensible sections embody tabs for insertion within slots in said right and left columns respectively whereby the frame provides a uniform and continuous appearance and the valence is supported by the columns. It is further preferred that the valance be positioned with one leg of the "L" facing forward (away from the perforated board) and downward and the other leg of the "L" being centrally supported by a substantially planar wire support brace (particularly when the valence is to be fully extended). In order to stabilize extension of the right and left extension members it is preferred that the central valance portion embody a track section into which said extension members are moveably fitted.

With specific reference to the drawings, display rack frame 10 in FIG. 1 is comprised of substantially parallel right and left column members 12 and 14 respectively which stand on existing store gondola 1 and are abutted against existing store perforated board 2. Top member valance 16 completes an aesthetic rectangular frame for displayed merchandise 15.

In FIGS. 2 and 3 the display rack 10 is shown in totally expanded condition A and in totally contracted position B. Between such extremes the frame is variable in both height and width in accordance with the spacing 'd' between holes in the perforated board 2. The width of the display rack frame 10 is controlled by the extent to which the valance 16 with right and left extension members 17 and 18 respectively can be extended or contracted. In fully contracted condition B the contracted width of the valance and the display rack frame is that of the central section 19. In fully expanded condition A the width of the display rack frame is that of the valance 16 (central portion 19 with extended right and left extension members 17 and 18).

In FIG. 4 the various support members for the members of the display frame are shown. Valance 16 is centrally supported by wire brace member 26 which is hooked onto the perforated board 2 by integral hook members 26*a* and 26*b*. Tabs 27 and 28 of right and left extensible members 17 and 18 are inserted into corresponding slots 22 and 24 of right and left column members 12 and 14 respectively to insure the appearance of a continuous frame for the merchandise 15 and to provide a stabilized support for the extensible members 17 and 18 respectively. Central portion 19 of the valance 16 embodies a U-shaped track portion 29 into which similarly shaped portions 29*a* and 29*b* of extensible members 17 and 18 respectively are disposed and are horizontally moveable in a directed manner.

Right and left column members 12 and 14 comprise base members 12*a* and 14*a* respectively which are nestingly contained within vertically moveable members 12*b* and 14*b* respectively. When the right and left column members 12 and 14 are properly positioned they are anchored to store gondola 1 by bracket members 32 and 34 respectively. Such bracket members may be disconnected from the gondola when lateral expansion or contraction of the display rack 10 is desired and re-anchored in new positions. Vertically moveable members 12*b* and 14*b* are fixed into various positions by means of support hooks 42 and 44 respectively which are held by perforated board 2 and which are inserted into apertures 42*b* and 44*b* respectively of said moveable members 12*b* and 14*b* respectively.

In an embodiment shown in FIG. 5 the valance 16 (decorative in nature) can be extended such as with panel 16*a* to include additional textual matter or decorations.

It is understood that the drawings disclose a preferred embodiment of the present invention and that changes may be made to the shape, structure and components without departing from the scope of the present invention. Thus for example, an adhesive board may be utilized in place of the perforated board, the display rack may rest on a floor or may be fully supported by the perforated board etc. These changes as well as others may be made without departing from the scope of the present invention as defined in the following claims.

What is claimed is:

1. An article display rack comprising, in combination, a base, a vertically standing article display member, and an aesthetic frame for said article display member, said frame comprising vertical right and left side members which are substantially parallel to each other and are in close vertical juxtaposition with said article display member, means supporting said right and left side members and said article display member in their respective vertical positions, said frame further comprising a top member positioned between the upper ends of said right and left side members and said base comprising the bottom of said frame, with said top member and said base being substantially parallel to each other, characterized in that said side members are vertically telescopical for vertical expansion and contraction of said frame, and wherein at least one side member is horizontally movable along said base with said top member being horizontally expandable and contractible in the direction of movement of said movable side member, whereby said framing enclosure is maintained for horizontal expansion and contraction of said frame, and means securing said top member to said vertically standing display member.

2. The rack of claim 1 wherein said article display member comprises a perforated board.

3. The rack of claim 2 wherein said base comprises a merchandise gondola.

4. The rack of claim 3 wherein each of said right and left side members comprises a hollow rectangular column comprising a base member and a vertically moveable member nestingly engaged with said base member.

5. The rack of claim 4 wherein the base member of each of said right and left side members is removeably affixed to said gondola.

6. The rack of claim 5 wherein the vertically moveable members of each of said right and left side members is supported by said perforated board.

7. The rack of claim 4 wherein said top member comprises a valance comprising a central section having right and left extensible sections nested therewith and wherein said extensible sections seatingly engaged with said right and left side members respectively.

8. A display rack including a base, a merchandise gondola, a vertically standing article display member comprising a perforated board, and an aesthetic frame comprising vertical right and left side members which are substantially parallel to each other and are in close vertical juxtaposition with said article display member, means supporting said right and left side members and said article display member in their respective vertical positions, said frame further comprising a top member positioned between the upper ends of said right and left side members and said base comprising the bottom of said frame with said top member and said base being substantially parallel to each other, characterized in that said side members are vertically telescopical for vertical expansion and contraction of said frame and whereby at least one side member is horizontally movable along said base with said top member being horizontally expandable and contractible in the direction of movement of said movable member whereby said framing enclosure is maintained for horizontal expansion and contraction of said frame; wherein each of said right and left side members comprises a hollow rectangular column comprising a base member and a vertically movable member nestingly engaged with said base member; wherein said top member comprises a valance comprising a central section having right and left extensible sections nested therewith and wherein said extensible sections are seatingly engaged with said right and left side members respectively and wherein said valance is L-shaped with one leg of said L extending downwardly and facing forward in a direction away from said perforated board, and wherein the other leg of said L is supportingly seated on a support brace attached to said perforated board.

9. The rack of claim 8 wherein said central section further embodies a track section into which said extension members are fitted for directed horizontal movement.

10. A display rack comprising an article support member comprising a perforated board vertically supported on a gondola, and a dimensionally adjustable frame for said support member, said frame comprising right and left hollow rectangular columns standing on said gondola and removably affixed thereto, with said columns being spaced from and substantially parallel to each other and vertically juxtaposed against said perforated board, means supporting said right and left columns and said article support member in their respective vertical positions, said frame further comprising an L-shaped valance member positioned between and supportingly engaged to the upper ends of said spaced columns and being substantially parallel to said gondola, with a frame being thereby formed between said right and left columns, said valance and said gondola; with a portion of said perforated board being accessible, within said frame, for the hanging of merchandise thereon, wherein said rectangular columns are each comprised of a base member and a vertically movable member nestingly engaged therewith, and wherein said valance member is comprised of a center section and right and left extension members horizontally movable in relation thereto, with one leg of said L facing downward and forward, in a direction away from said perforated board, and the other leg of said L being centrally supportingly engaged with a wire support brace hooked onto said perforated board and wherein said vertically movable members are removably engaged to said perforated board.

* * * * *